US006385792B1

(12) United States Patent
Clutter

(10) Patent No.: US 6,385,792 B1
(45) Date of Patent: May 14, 2002

(54) SOLAR COVER FOLDER

(76) Inventor: Ernest N. Clutter, 2026 Bristol-Champion Townline Rd., Bristolville, OH (US) 44403

( * ) Notice: Subject to any disclaimer, the term of this patent is extended or adjusted under 35 U.S.C. 154(b) by 0 days.

(21) Appl. No.: 09/788,434

(22) Filed: Feb. 21, 2001

(51) Int. Cl.[7] ..... E04H 4/00
(52) U.S. Cl. ..... 4/502; 242/578; 242/613
(58) Field of Search ..... 4/502; 242/578, 242/604, 613, 613.1, 613.3, 918, 919

(56) References Cited

U.S. PATENT DOCUMENTS

| | | | | | |
|---|---|---|---|---|---|
| 1,066,319 | A | * | 7/1913 | Powell | 242/578 |
| 2,012,791 | A | * | 8/1935 | Luchtenberg | 242/604 X |
| 4,195,370 | A | | 4/1980 | Budd | 4/502 |
| 4,324,370 | A | | 4/1982 | Guard et al. | 4/502 X |
| 4,328,930 | A | | 5/1982 | Kalendovsky | 4/498 X |
| 4,467,978 | A | | 8/1984 | Farrington | 4/502 X |
| 4,471,500 | A | | 9/1984 | Long et al. | 4/502 X |
| 5,516,059 | A | * | 5/1996 | Gudgeon et al. | 242/578 X |
| 5,557,811 | A | | 9/1996 | Hoff | 4/502 |

* cited by examiner

*Primary Examiner*—Robert M. Fetsuga
(74) *Attorney, Agent, or Firm*—Siemens Patent Services, LC

(57) ABSTRACT

The present invention is a light weight, easily used device designed for folding, storing and unfolding a floating solar swimming pool cover. In its preferred embodiment, the solar cover folder is an expandable, elongated loop which can be placed on the top surface of a floating swimming pool solar cover. After folding approximately the first two feet of the cover up and over said folder, said folder and the cover can then be folded back repeatedly until the entire cover has been rolled on the folder. Once the cover has been completely rolled onto the folder, it may either be left floating at the edge of the pool, lifted to rest on the side of the pool or removed to a remote location for storage.

6 Claims, 2 Drawing Sheets

SOLAR COVER FOLDER

BACKGROUND OF THE INVENTION

1. Field of the Invention

The present invention relates to the field of swimming pools and the heating and maintenance thereof. More particularly, the invention comprises a device for folding swimming pool solar cover designed such that a single individual can easily fold and store said solar cover.

2. Description of the Prior Art

For a number of reasons, swimming pool owners find it desirable to keep their pool covered when not in use. A cover provides a safety measure, aids in keeping debris out of the pool, and especially in the case of a solar cover, provides solar gain for heating of the pool. By virtue of the size of swimming pools, however, covers are typically hard to manipulate, especially in a home environment where an individual may typically have to handle the cover alone.

A number of devices for aiding in the handling of swimming pool covers exist, but they are typically designed for use with an in ground pool where the device can mount on or roll along the apron around the pool. Most above ground pools, however, do not have an apron, presenting a unique problem in covering/ uncovering them.

U.S. Pat. No. 5,557,811, issued to David D. Hoff on Sep. 24, 1996, relates to a device comprising a pair of tubes deployed across the width of a floating, buoyant swimming pool cover, one across the lower surface and one across the upper surface thereof, and joined together at each end. In a second embodiment, a single tube is deployed across the upper surface of the cover and secured to each side by adjustable clips. In either embodiment, a crank mounted at one end of the tubes is used to crank the floating cover onto the drum created by the tubes. Unlike the present invention, room is required along the side of the pool for operating the crank.

U.S. Pat. No. 4,195,370, issued to Joe A. Budd on Apr. 1, 1980, and U.S. Pat. No. 4,324,370, issued to Wayne Guard, et. al., on Apr. 13, 1982, relate to devices employing wheeled carriages which roll along the apron on either side of a pool with a roller mounted between said carriages for holding the cover as it is wound onto said roller. Budd and Guard are functional with an in ground pool with an adjacent apron, but the absence of an apron in an above ground pool does not allow a surface upon which the carriages may roll. The present invention, on the other hand, is flexible enough that it can be used in either an in ground or above ground pool.

U.S. Pat. No. 4,328,930,issued to Jiri Kalendovsky on May 11, 1982, and U.S. Pat. No. 4,467,978, issued to Douglas I. Farrington on Aug. 28, 1984 relate to devices consisting of a pair of stands between which is mounted a reel onto which a pool cover is wound. Said stands are free standing and could be adjusted for use with either an in ground or above ground pool, but unlike the present invention which has only one piece, Kalendovsky and Farrington require considerably more space for storage when not in use.

U.S. Pat. No. 4,471,500, issued to Robert E. Long, et. al., on Sep. 18, 1984, refers to a self rolling swimming pool cover wherein water flowing into flexible conduits on the under side of a buoyant cover forces said cover to unroll along the surface of the pool and tension springs force said cover to recoil when pressure is released from said conduits. Said cover is at least a semi-permanently installed cover operating on pressure supplied by the recirculating pump of the pool's filtration system, and unlike the present invention, with which the cover can be completely removed from the pool, said cover must occupy the space along one end of the pool at all times when in the rolled position.

None of the above inventions and patents, taken either singly or in combination, is seen to describe the instant invention as claimed.

SUMMARY OF THE INVENTION

The present invention provides an inexpensive and convenient method for folding and storing a buoyant solar cover as is frequently floated on the surface of a swimming pool.

Accordingly, it is a principal object of the invention to provide an inexpensive device for folding, storing and unfolding a solar swimming pool cover.

It is another object of the invention to provide a light weight device for folding, storing and unfolding a solar swimming pool cover.

It is a further object of the invention to provide a solar cover folding device which can be stored in a compact configuration when not in use.

Still another object of the invention is to provide a solar cover folding device which is adjustable to accommodate covers of various sizes.

An additional object of the invention is to provide a device for folding, storing and unfolding a solar swimming pool cover which can easily be used by a single individual.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

The present invention is a light weight, easily used device designed for folding, storing and unfolding a floating solar swimming pool cover. In its preferred embodiment, the solar cover folder is an expandable, elongated loop which can be placed on the top surface of a floating swimming pool solar cover. After making an initial fold of approximately the first two feet of the cover up and over said folder, said folder and the cover can then be folded back repeatedly until the entire cover has been rolled on the folder. Once the cover has been completely rolled onto the folder, it may either be left floating at the edge of the pool, lifted to rest on the side of the pool or removed to a remote location for storage.

Figures 1, 2:
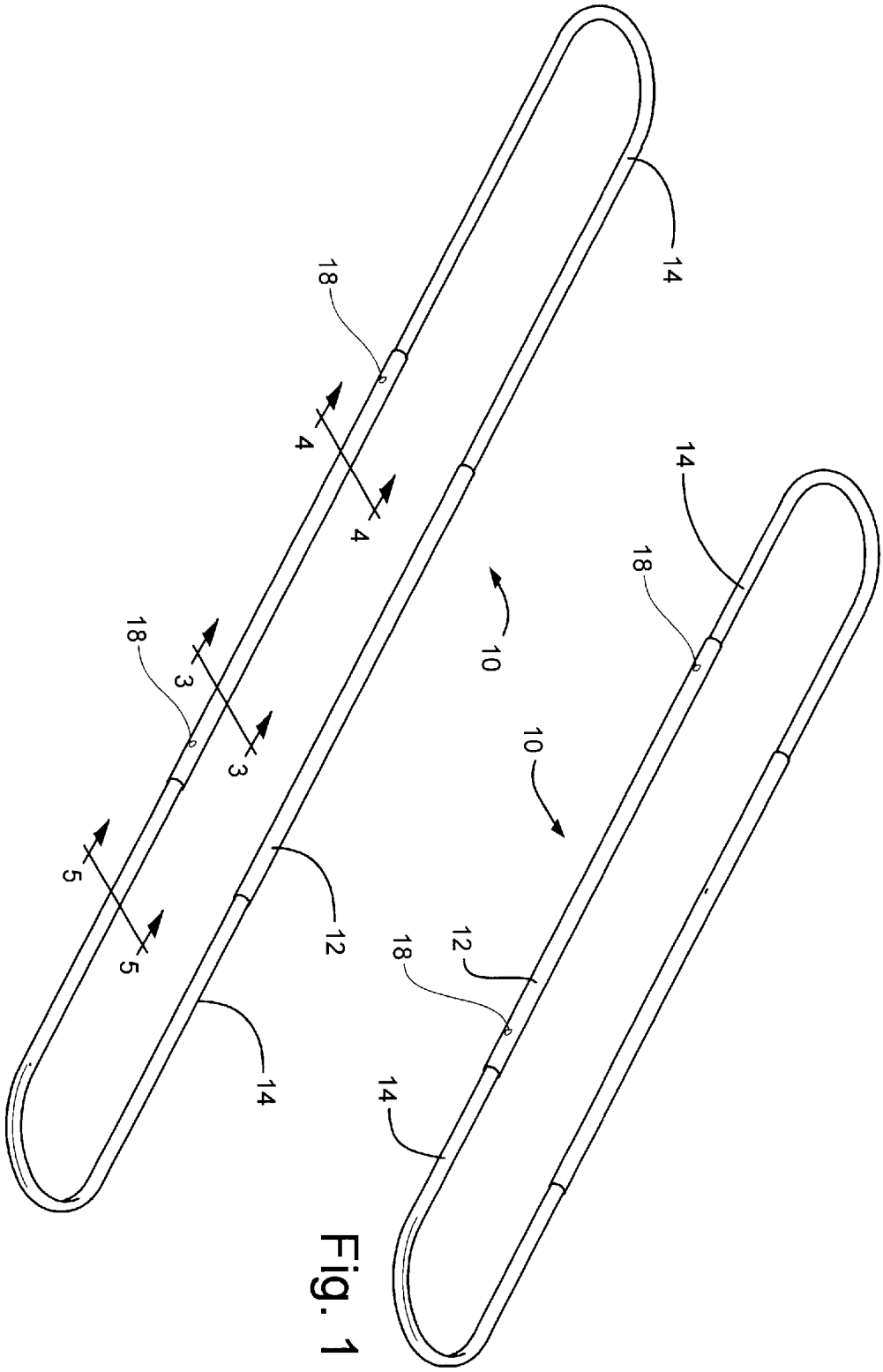
FIG. 1 is an environmental perspective of the solar cover folder in its compacted mode.
FIG. 2 is an environmental perspective of the solar cover folder in its extended mode.

FIG. 1 shows solar cover folder 10 comprised of two connectors 12 and two end extensions 14. Connector 12 is a straight piece, of hollow, open ended tubing, which in the preferred embodiment is round. End extension 14 is of tubular construction similar to that of connector 12, having an external diameter slightly less than the interior diameter of connector. End extension 14 is bent to form an overall shape resembling the letter U. The opposite ends of one end extension 14 are telescoped into one end of each of the two connectors 12. The opposite ends of a second end extension 14 are telescoped into the opposite ends of the two connectors 12, forming an elongated loop. For ease in storing when not in use, solar cover folder 10 can be reduced by pushing each end extension 14 into connectors 12 until the ends of said end extensions 14 meet in the proximate center of connectors 12. Solar cover folder 10 is secured in either its extended or reduced configuration by set screws 18, through tapped hole 16 in each end of connectors 12. In the preferred embodiment, connector 12 is approximately 60" in length, while end extension 14 is approximately 66" in length. Said dimensions allow solar cover folder 10 to be reduced to approximately 11' in length and extended to approximately 15' in length.

Solar cover folder 10 may be used in its extended mode, as shown in FIG. 2, by pulling the two end extensions 14 out of connectors 12 to a sufficient length for use in folding a solar cover, while keeping the ends extensions 14 engaged with connectors 12 at a minimum of 6' in order to retain sufficient rigidity.

Figure 3:
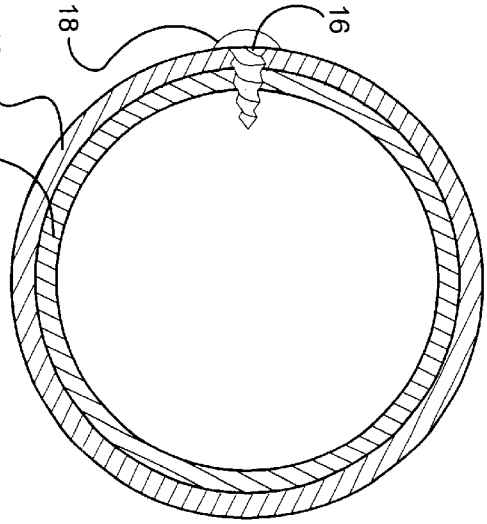
FIG. 3 is a cross sectional view of a connector essentially at line 3—3 of FIG. 2.

FIG. 3 shows a cross section of the preferred embodiment of end extension 14 engaged inside of connector 12 essentially at line 3—3, of FIG. 2, depicting the fitting of connector 12 and end extension 10, as well as set screw 18 and hole 16.

Figure 4:
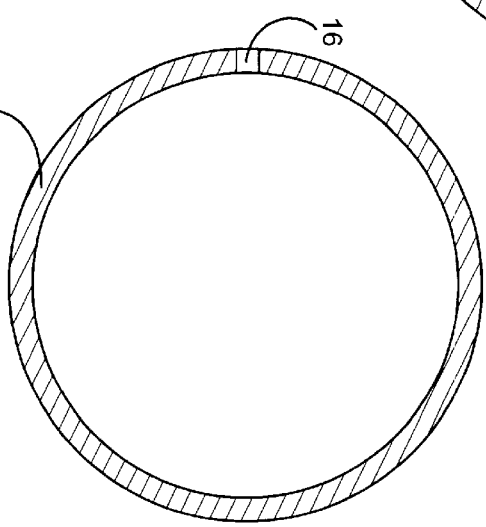
FIG. 4 is a cross sectional view of an end extension essentially at line 4—4 of FIG. 2.

FIG. 4 shows a cross section of the preferred embodiment of connector 12 essentially at line 4—4 of FIG. 2.

Figure 5:
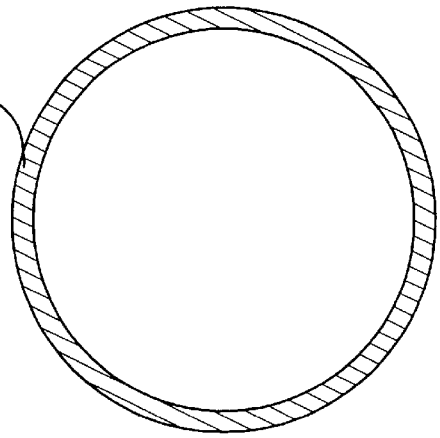
FIG. 5 is a cross sectional view of the joined connector and end extension at line 5—5 of FIG. 2.

FIG. 5 shows a cross section of the preferred embodiment of end extension 14 at line 5—5 of FIG. 2.

While the preferred embodiment of solar cover folder 10 is of tubular aluminum, it would be evident to one skilled in the art that construction could be of any number of different materials such as, but not limited to a heat resistant plastic, such as PVC.

Likewise, it would be evident to one skilled in the art that the design of the interlocking connection between connector 12 and end extension 14 need not be exactly as presented, but could be of any number of designs, such as, but not limited to, square or oval, or ribbed or keyed, which would allow the same sliding connection while providing rigidity.

It would be further evident to one skilled in the art that said solar cover folder could be made in a variety of sizes to accommodate covers for pools of varying sizes and that additional segments of connector 12 could be utilized.

It is to be understood that the present invention is not limited to the embodiments described above, but encompasses any and all embodiments within the scope of the following claims.

I claim:

1. A cover folder for folding a swimming pool cover comprising;

a elongated loop formed by two parallel connectors joined at their ends by U shaped end extensions, wherein said cover folder said swimming pool cover is folded by progressively rolling said cover around the plane formed by said parallel connectors.

2. A cover folder as defined in claim 1, wherein;

said parallel connectors are of a hollow cross section, with open ends;

joined at each end by U shaped end extensions of solid cross section;

with said connectors having a cross sectional shape such that the ends of said end extensions fit into the open ends connectors to form a telescoping joint;

said solar cover folder, when fully assembled, forming said elongated loop, the length of which can be reduced or extended by varying the distance said end extensions are telescoped into said hollow connectors; and securing means providing rigidity against both lateral and rotational motion.

3. A cover folder as defined in claim 2 wherein:

the cross sectional shape of said connectors and said end extensions is that of a round, hollow tube, and said securing means comprises a set screw disposed at each of the two ends of each section of said connectors, providing a connection between said connectors and said end pieces which will ensure that said folder will maintain a flat profile, without any twisting as said cover is rolled onto said folder.

4. A cover folder as defined in claim 2 comprising additional telescoping connectors of increasing cross sectional dimensions so as to allow said telescoping connectors to be telescoped into another of successively larger dimension in order to allow multiple telescoping actions, thus accommodating covers of larger size while maintaining a more compact configuration of said folder for storage when not in use.

5. A cover folder as defined in claim 1, wherein said cover folder is constructed of extruded, tubular aluminum.

6. A cover folder as defined in claim 1, wherein said cover folder is constructed of PVC plastic.

* * * * *